US011062834B2

(12) United States Patent
Kaneko et al.

(10) Patent No.: US 11,062,834 B2
(45) Date of Patent: Jul. 13, 2021

(54) COIL COMPONENT

(71) Applicant: TDK CORPORATION, Tokyo (JP)

(72) Inventors: Shigeru Kaneko, Tokyo (JP); Toshio Tomonari, Tokyo (JP)

(73) Assignee: TDK CORPORATION, Tokyo (JP)

( * ) Notice: Subject to any disclaimer, the term of this patent is extended or adjusted under 35 U.S.C. 154(b) by 258 days.

(21) Appl. No.: 16/159,523

(22) Filed: Oct. 12, 2018

(65) Prior Publication Data

US 2019/0115137 A1 Apr. 18, 2019

(30) Foreign Application Priority Data

Oct. 16, 2017 (JP) ..... 2017-200474

(51) Int. Cl.

| | |
|---|---|
| ***H01F 5/00*** | (2006.01) |
| ***H01F 17/00*** | (2006.01) |
| ***H01F 27/28*** | (2006.01) |
| ***H01F 41/061*** | (2016.01) |
| ***H01F 41/04*** | (2006.01) |
| ***H01F 27/29*** | (2006.01) |

(52) U.S. Cl.

CPC ..... *H01F 17/0033* (2013.01); *H01F 5/003* (2013.01); *H01F 27/2804* (2013.01); *H01F 27/29* (2013.01); *H01F 27/292* (2013.01); *H01F 41/042* (2013.01); *H01F 41/061* (2016.01); *H01F 2017/006* (2013.01); *H01F 2017/0073* (2013.01)

(58) Field of Classification Search

CPC ..... H01F 2017/006; H01F 2017/0073; H01F 27/2804

USPC ..... 336/200

See application file for complete search history.

(56) References Cited

U.S. PATENT DOCUMENTS

| | | | | |
|---|---|---|---|---|
| 7,417,523 | B2 * | 8/2008 | Waffenschmidt | H05K 1/165 336/200 |
| 2009/0309579 | A1 * | 12/2009 | Cochran | A61B 5/1126 324/207.16 |
| 2013/0187744 | A1 * | 7/2013 | Seko | H01F 17/0013 336/200 |
| 2017/0278619 | A1 * | 9/2017 | Lee | H02J 50/10 |

FOREIGN PATENT DOCUMENTS

| | | |
|---|---|---|
| CN | 202838351 U | 3/2013 |
| JP | 2008-205215 A | 9/2008 |

* cited by examiner

*Primary Examiner* — Ronald Hinson

(74) *Attorney, Agent, or Firm* — Young Law Firm, P.C.

(57) ABSTRACT

Disclosed herein is a coil component that includes a substrate having a first surface and a first spiral coil spirally wound in a plurality of turns formed on the first surface of the substrate. Each of the turns has a first circumference region in which a radial position is substantially fixed and a first shift region in which a radial position is shifted. Each of inner and outer peripheral ends of the first spiral coil is positioned at the first shift region.

14 Claims, 11 Drawing Sheets

COIL COMPONENT

BACKGROUND OF THE INVENTION

Field of the Invention

The present invention relates to a coil component and, more particularly, to a coil component having a spiral-shaped planar conductor.

Description of Related Art

As a coil component used for various electronic devices, a coil component of a type in which a wire (coated wire) is wound around a magnetic core and, further, a coil component of a type in which a spiral-shaped planar conductor of a plurality of turns is formed on an insulating layer are known. For example, JP 2008-205215 A discloses a coil component having a configuration in which spiral-shaped coil parts are formed on a plurality of insulating layers, respectively, and the inner peripheral ends thereof are connected to one another.

However, in the coil component described in JP 2008-205215 A, the spiral-shaped coil part has a spiral shape as a whole, that is, a shape in which the radial position of the conductor is gradually changed, complicating pattern design or pattern change. As shown in FIG. 11, to solve this problem, there can be adopted a method not forming the spiral coil part into a spiral shape as a whole, but constituting each turn of a circumference region A in which the radial position of the conductor is not changed and a shift region B in which the radial position of the conductor is shifted. This eliminates the need of gradually changing the radial position of the conductor, facilitating pattern design or pattern change.

However, when the spiral-shaped coil part is formed into the pattern shape illustrated in FIG. 11, the peripheral position of the inner peripheral end Ti and that of the outer peripheral end To are significantly separated from each other, resulting in a layout in which the shift region B is positioned between the inner peripheral end Ti and the outer peripheral end To. The peripheral position of the inner peripheral end Ti is a position overlapping the long dashed dotted line L1 radially extending from the center point C of the coil part, and the peripheral position of the outer peripheral end To is a position overlapping the long dashed dotted line L2 radially extending from the center point C of the coil part.

Thus, when two coil parts having the configuration as illustrated in FIG. 11 are put one over the other so as to make current circulation directions thereon coincide with each other, and then the inner peripheral ends Ti are connected to each other, the peripheral position of the outer peripheral end To of one coil part and that of the outer peripheral end To of the other coil part are separated further apart from each other. The peripheral position of the outer peripheral end To of the other coil part is a position overlapping the long dashed dotted line L3 radially extending from the center point C of the coil part. Thus, when the terminal electrodes E1 and E2 are provided at the outer peripheral ends To of the one and the other coil parts, respectively, the peripheral positions of the terminal electrodes E1 and E2 are significantly separated from each other, resulting in complicated connection structure between the terminal electrodes E1, E2 and a circuit board.

To solve the above problem, a method of extending the outer peripheral end To of the coil part up to the peripheral position denoted by the long dashed dotted line L1 or a method of extending the inner peripheral end Ti of the coil part up to the peripheral position denoted by the long dashed dotted line L2 can be adopted. In this case, however, an additional circumference region A having a reduced peripheral distance is generated, disadvantageously increasing the size of the coil outer shape or reducing the size of the coil inner diameter region. That is, when the outer peripheral end To of the coil part is extended up to the peripheral position denoted by the long dashed dotted line L1 or when the inner peripheral end Ti of the coil part is extended up to the peripheral position denoted by the long dashed dotted line L2, six circumference regions A are required although the number of turns is five. This degrades pattern efficiency to increase the size of the coil outer shape in the former case and to significantly reduce the size of the coil inner diameter region in the latter case.

SUMMARY

It is therefore an object of the present invention to provide a coil component capable of making the peripheral positions of a pair of terminal electrodes adjacent to each other while suppressing increase in the size of the coil outer shape and reduction in the size of the coil inner diameter region.

A coil component according to the present invention includes: an insulating substrate; a first coil part formed on one surface of the insulating substrate and spirally wound in a plurality of turns; a second coil part formed on the other surface of the insulating substrate and spirally wound in a plurality of turns; and a connection part formed so as to penetrate the insulating substrate and connecting the inner peripheral end of the first coil part and the inner peripheral end of the second coil part. The outer peripheral end of the first coil part and the outer peripheral end of the second coil part are disposed adjacent to each other in a plan view. The plurality of turns constituting the first and second coil parts each have a circumference region in which the radial position is not changed and a shift region in which the radial position is shifted. The shift region is positioned on a virtual line radially extending from the center point of the first and second coil parts and passing between the outer peripheral end of the first coil part and the outer peripheral end of the second coil part.

According to the present invention, the shift region is disposed on the virtual line passing between the outer peripheral end of the first coil part and the outer peripheral end of the second coil part. Thus, even when the outer peripheral ends of the respective first and second coil parts are disposed adjacent to each other, increase in the size of the outer shape of the coil component can be prevented.

In the present invention, the inner peripheral ends of the respective first and second coil parts may be positioned within the shift region. This can minimize reduction in the size of the coil inner diameter region.

In the present invention, the inner peripheral ends of the respective first and second coil parts may be positioned on the virtual line in a plan view. This can make the pattern shape of the first coil part and the pattern shape of the second coil part identical to each other.

In the present invention, the first coil part may be radially separated by a spiral-shaped slit into first and second conductor parts, and the second coil part may be radially separated by a spiral-shaped slit into third and fourth conductor parts. This allows reduction in non-uniformity of current density distribution to make it possible to reduce DC resistance or AC resistance.

In the present invention, the first conductor part may be positioned at the outer peripheral side of the second conductor part, the third conductor part may be positioned at the outer peripheral side of the fourth conductor part, and the connection part may have a first connection part connecting the inner peripheral end of the first conductor part and the inner peripheral end of the fourth conductor part, and a second connection part connecting the inner peripheral end of the second conductor part and the inner peripheral end of the third conductor part. This further uniformizes current density distribution between the conductor parts positioned at the inner peripheral and outer peripheral sides to make it possible to further reduce DC resistance or AC resistance.

In the present invention, the first coil part may include a first turn positioned at the innermost periphery and a second turn positioned at the outer peripheral side of the first turn by one turn, the second coil part may include a third turn positioned at the innermost periphery and a fourth turn positioned at the outer peripheral side of the third turn by one turn, and the connection part may have a third connection part connecting the first and fourth turns and a fourth connection part connecting the second and third turns. This allows the total number of turns to be an odd number.

In the present invention, the circumference regions of a plurality of turns constituting the first coil part and the circumference regions of a plurality of turns constituting the second coil part may coincide with each other in planar position. This facilitates outer appearance inspection when the insulating substrate is transparent or translucent.

As described above, according to the present invention, it is possible to make the peripheral positions of the pair of terminal electrodes adjacent to each other while suppressing increase in the size of the outer shape of the coil component and reduction in the size of the coil inner diameter region.

BRIEF DESCRIPTION OF THE DRAWINGS

The above features and advantages of the present invention will be more apparent from the following description of certain preferred embodiments taken in conjunction with the accompanying drawings, in which.

DETAILED DESCRIPTION OF THE EMBODIMENTS

Preferred embodiments of the present invention will be explained below in detail with reference to the accompanying drawings.

First Embodiment

Figure 1:
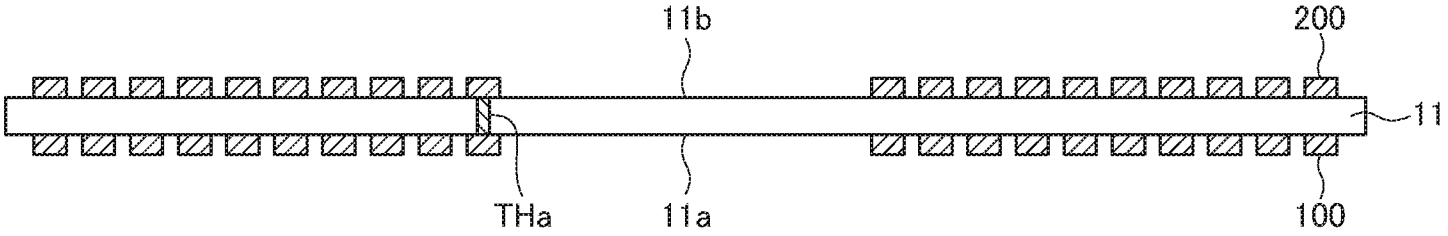
FIG. 1 is a cross-sectional view illustrating the configuration of a coil component according to a first embodiment of the present invention.

FIG. 1 is a cross-sectional view illustrating the configuration of a coil component according to the first embodiment of the present invention.

As illustrated in FIG. 1, the coil component according to the present embodiment includes an insulating substrate 11, a first coil part 100 formed on one surface 11*a* of the insulating substrate 11, and a second coil part 200 formed on the other surface 11*b* of the insulating substrate 11. Although details will be described later, an inner peripheral end Ti of the first coil part 100 and an inner peripheral end Ti of the second coil part 200 are connected to each other through a connection part THa penetrating the insulating substrate 11.

Although there is no particular restriction on the material for the insulating substrate 11, a transparent or translucent flexible material such as PET resin may be used. Alternatively, the insulating substrate 11 may be a flexible substrate obtained by impregnating glass cloth with epoxy-based resin. When the insulating substrate 11 is transparent or translucent, the first coil part 100 and second coil part 200 are seen overlapping each other in a plan view. Thus, outer appearance inspection using an outer appearance inspection device becomes difficult depending on how they overlap each other. Although details will be described later, in the coil component according to the present embodiment, the first and second coil parts 100 and 200 are disposed overlapping each other for the most part so as to allow outer appearance inspection using an outer appearance inspection device to be executed properly.

Figure 2:
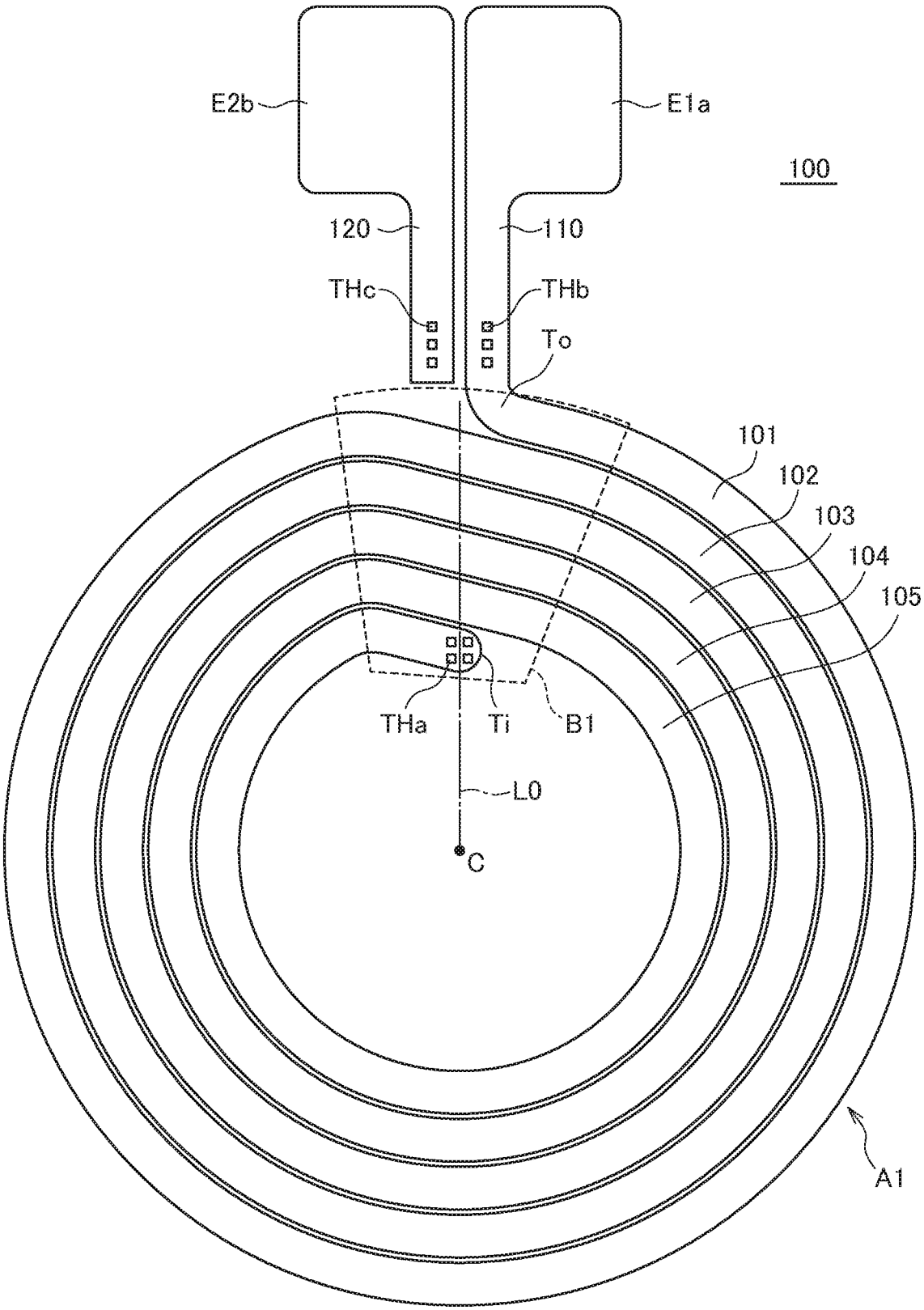
FIG. 2 is a plan view illustrating the pattern shape of the first coil part as viewed from one side of the insulating substrate.

FIG. 2 is a plan view illustrating the pattern shape of the first coil part 100 as viewed from the surface 11*a* side of the insulating substrate 11.

As illustrated in FIG. 2, the first coil part 100 is constituted of a planar conductor spirally wound in a plurality of turns. In the example of FIG. 2, the first coil part 100 has five turns including turns 101 to 105, in which the turns 101 and 105 are positioned at the outermost and innermost peripheries, respectively. An outer peripheral end To of the first coil part 100 is connected to a terminal electrode E1*a* through a radially extending lead-out pattern 110. Further, a radially extending lead-out pattern 120 is provided peripherally adjacent to the lead-out pattern 110, and the leading end portion thereof is connected to a terminal electrode E2*b*.

The turns 101 to 105 constituting the first coil part 100 each have a circumference region A1 in which the radial position is not changed and a shift region B1 in which the radial position is shifted. The five turns including the turns 101 to 105 are defined with the shift region B1 as a boundary. As illustrated in FIG. 2, in the present embodiment, both the outer peripheral end To and inner peripheral end Ti of the first coil part 100 are positioned within the shift region B1. Further, when a virtual line L0 radially extending from a center point C of the first coil part 100 and passing between the lead-out patterns 110 and 120 is drawn, the shift region B is positioned on the virtual line L0. Further, the inner peripheral end Ti of the first coil part 100 is also positioned on the virtual line L0.

Figure 3:
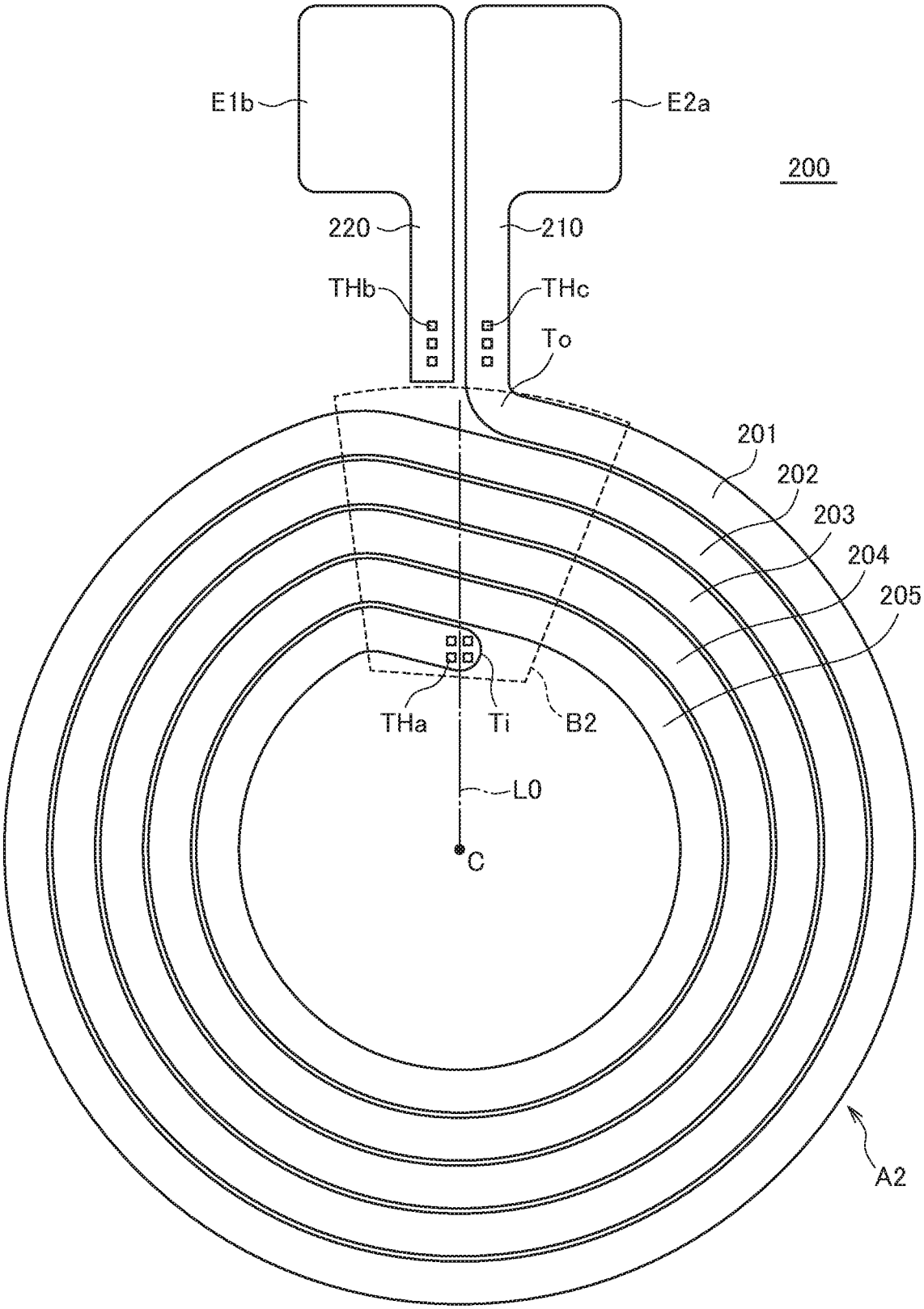
FIG. 3 is a plan view illustrating the pattern shape of the first coil part as viewed from the other side of the insulating substrate.

FIG. 3 is a plan view illustrating the pattern shape of the second coil part 200 as viewed from the surface 11*b* side of the insulating substrate 11.

As illustrated in FIG. 3, the second coil part 200 has the same pattern shape as the first coil part 100. Accordingly, the first and second coil parts 100 and 200 can be manufactured using the same mask, allowing the manufacturing cost to be significantly reduced. The second coil part 200 has five turns including turns 201 to 205, in which the turns 201 and 205 are positioned at the outermost and innermost peripheries, respectively. An outer peripheral end To of the second coil part 200 is connected to a terminal electrode Eta through a radially extending lead-out pattern 210. Further, a radially extending lead-out pattern 220 is provided peripherally adjacent to the lead-out pattern 210, and the leading end portion thereof is connected to a terminal electrode E1*b*.

The turns 201 to 205 constituting the second coil part 200 each have a circumference region A2 in which the radial position is not changed and a shift region B2 in which the radial position is shifted. As described above, the first and second coil parts 100 and 200 have the same planar shape, so that the virtual line L0 passes between the outer peripheral end To of the first coil part 100 and the outer peripheral end To of the second coil part 200. The inner peripheral end Ti of the second coil part 200 is also positioned on the virtual line L0.

The thus configured first and second coil parts 100 and 200 are formed on the surfaces 11*a* and 11*b* of the insulating substrate 11, respectively.

Figure 4:
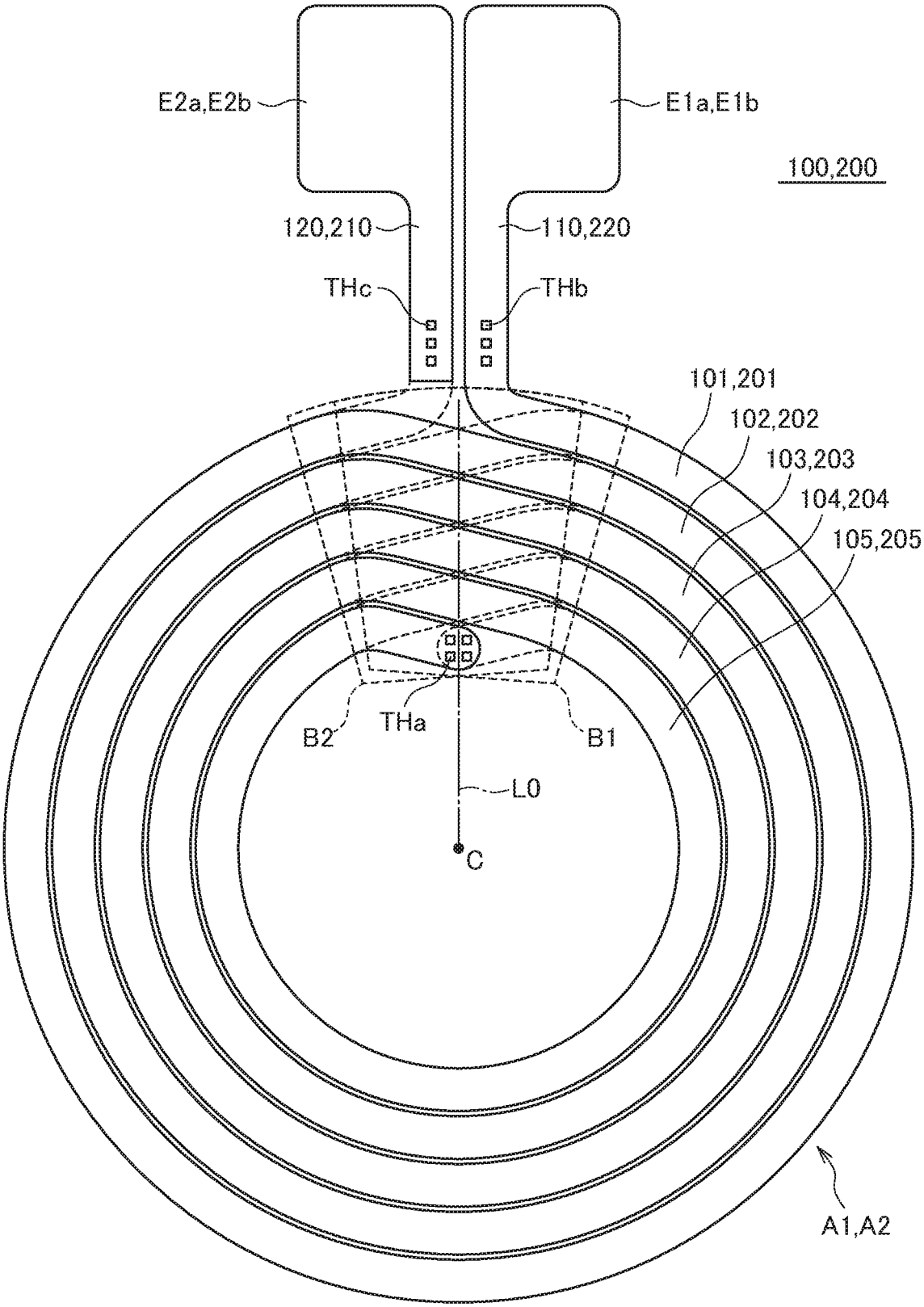
FIG. 4 is a transparent plan view illustrating how the first and second coil parts overlap each other.

FIG. 4 is a transparent plan view illustrating how the first and second coil parts 100 and 200 overlap each other as viewed from the surface 11*a* side of the insulating substrate 11.

Figure 5:
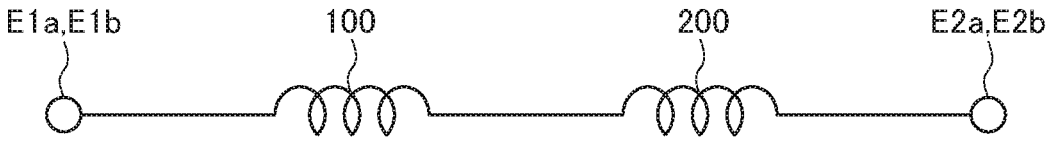
FIG. 5 is an equivalent circuit diagram of the coil component according to the first embodiment of the present invention.

As illustrated in FIG. 4, the first and second coil parts 100 and 200 are formed on the front and back surfaces of the insulating substrate 11, respectively, such that the center points C thereof coincide with each other and that the terminal electrodes E1*a* and E2*a* overlap the terminal electrodes E1*b* and E2*b*, respectively. As a result, the circumference regions A1 of the respective turns 101 to 105 constituting the first coil part 100 and the circumference regions A2 of the respective turns 201 to 205 constituting the second coil part 200 overlap each other for the most part in a plan view. Further, the inner peripheral end Ti of the first coil part 100 and the inner peripheral end Ti of the second coil part 200 are connected to each other through the connection part THa penetrating the insulating substrate 11. As a result, the first and second coil parts 100 and 200 are connected in series to each other as illustrated in FIG. 5, thereby constituting a spiral coil of 10 turns in total.

Further, the lead-out patterns 110 and 220 are connected to each other through a connection part THb penetrating the insulating substrate 11. Similarly, the lead-out patterns 120 and 210 are connected to each other through a connection part THc penetrating the insulating substrate 11. As a result, the terminal electrodes E1*a* and E1*b* are short-circuited, and the terminal electrodes E2*a* and E2*b* are short-circuited. Although four connection parts THa, three connection parts THb, and three connection parts THc are formed in the present embodiment, the number of each of the connection portions is not particularly limited.

The above is the configuration of the coil component according to the present embodiment. As described above, the coil component according to the present embodiment is constituted of the first and second coil parts 100 and 200 having the same planar shape, so that the first and second coil parts 100 and 200 can be manufactured using the mask having the same pattern shape, allowing the manufacturing cost to be significantly reduced. In addition, the first and second coil parts 100 and 200 overlap each other for the most part in a plan view excluding a portion overlapping the shift regions B1 and B2, so that even when the insulating substrate 11 is transparent or translucent, visual interference between the first and second coil parts 100 and 200 can be minimized. That is, when the outer appearance of the first coil part 100 is inspected, the second coil part 200 does not serve as a visual obstruction and, conversely, when the outer appearance of the second coil part 200 is inspected, the first coil part 100 does not serve as visual obstruction. This allows outer appearance inspection using an outer appearance inspection device to be executed properly.

Further, in the coil component according to the present embodiment, the outer peripheral ends To and inner peripheral ends Ti of the first and second coil parts 100 and 200 are disposed within the shift region (B1, B2). Thus, although the outer peripheral end To of the first coil part 100 and the outer peripheral end To of the second coil part 200 are disposed adjacent to each other, it is possible to prevent increase in the size of the outer shape of the coil component or reduction in the size of the coil inner diameter region due to enlargement of the circumference regions A1 and A2.

Second Embodiment

Next, a coil component according to the second embodiment will be described. The coil component according to the second embodiment differs from the coil component according to the first embodiment in that the above-described first and second coil parts 100 and 200 are replaced by first and second coil parts 100A and 200A. Other configurations are the same as those of the coil component according to the first embodiment, so the same reference numerals are given to the same elements, and overlapping description will be omitted.

Figure 6:
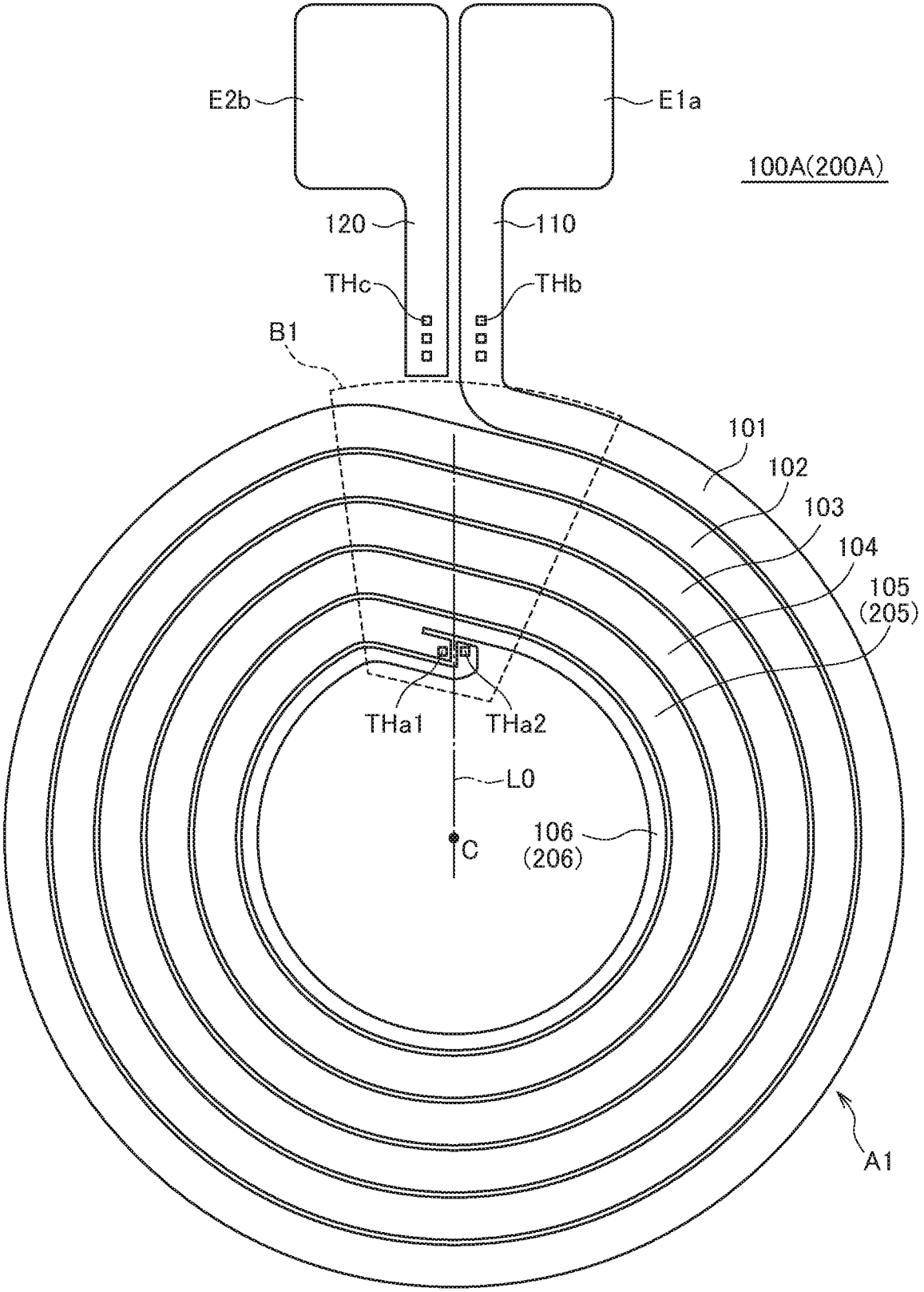
FIG. 6 is a plan view illustrating the pattern shape of a first coil part according to a second embodiment of the present invention as viewed from one side of the insulating substrate.

FIG. 6 is a plan view illustrating the pattern shape of the first coil part 100A as viewed from the surface 11*a* side of the insulating substrate 11. Also in the present embodiment, the first and second coil parts 100A and 200A have the same pattern shape, so reference numerals corresponding to the second coil part 200A are given in parentheses in FIG. 6.

As illustrated in FIG. 6, the first coil part 100A differs from the first coil part 100 illustrated in FIG. 2 in that a turn 106 is added to the inner peripheral side of the turn 105. The conductor width of the turn 106 is about half the conductor width of each of the turns 101 to 105. The inner peripheral end of the turn 105 is branched from the turn 106 and has a connection part THa1. On the other hand, a connection part THa2 is formed at the inner peripheral end of the turn 106. The connection parts THa1 and THa2 are formed so as to be symmetrical with respect to the virtual line L0.

Thus, when the first and second coil parts 100A and 200A are put one over the other through the insulating substrate 11, the inner peripheral end of the turn 105 of the first coil part 100A and the inner peripheral end of the turn 206 of the second coil part 200A are connected through the connection part THa1, and the inner peripheral end of the turn 106 of the first coil part 100A and the inner peripheral end of the turn 205 of the second coil part 200A are connected through the connection part THa2. As a result, a spiral coil of 11 turns in total is constituted, that is, it is possible to realize a spiral coil of an odd number of turns although the coil parts having the same pattern shape are used on the front and back surfaces of the insulating substrate 11.

Third Embodiment

Next, a coil component according to the third embodiment will be described. The coil component according to the third embodiment differs from the coil component according to the first embodiment in that the above-described first and second coil parts 100 and 200 are replaced by first and second coil parts 100B and 200B. Other configurations are the same as those of the coil component according to the first embodiment, so the same reference numerals are given to the same elements, and overlapping description will be omitted.

Figure 7:
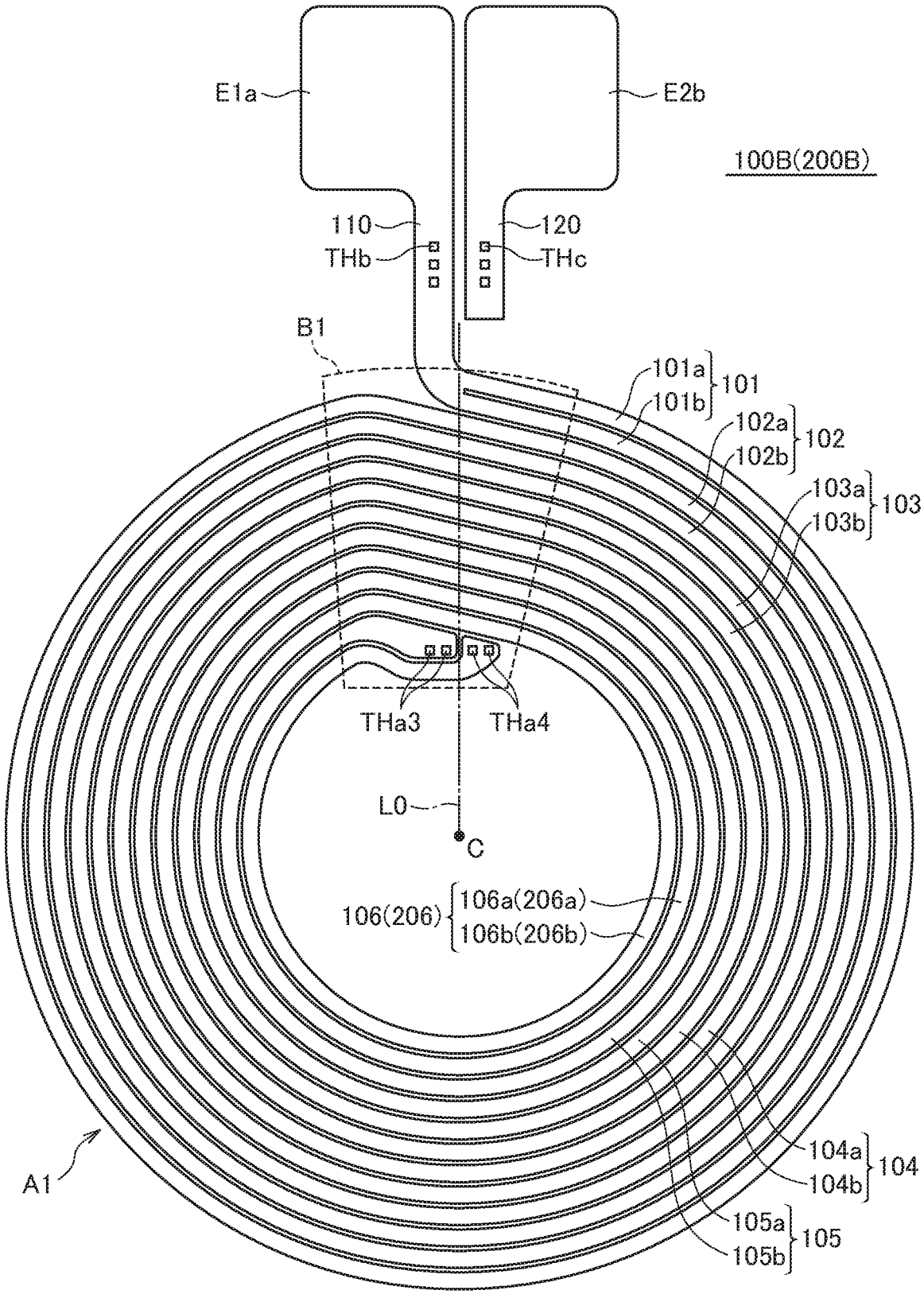
FIG. 7 is a plan view illustrating the pattern shape of a first coil part according to a third embodiment of the present invention as viewed from one side of the insulating substrate.

FIG. 7 is a plan view illustrating the pattern shape of the first coil part 100B as viewed from the surface 11*a* side of the insulating substrate 11. Also in the present embodiment, the first and second coil parts 100B and 200B have the same pattern shape, so reference numerals corresponding to the second coil part 200B are given in parentheses in FIG. 7.

As illustrated in FIG. 7, the first coil part 100B has six turns including turns 101 to 106 and, thus, a spiral coil of 12 turns in total is constituted. The turns 101 to 106 are each radially separated by a spiral-shaped slit. As a result, the turns 101 to 106 are separated into conductor parts 101*a* to 106*a* positioned at the outer peripheral side and conductor parts 101*b* to 106*b* positioned at the inner peripheral side. A connection part THa3 is formed at the inner peripheral end of the conductor part 106*a* of the turn 106 which is the innermost turn, and a connection part THa4 is formed at the inner peripheral end of the conductor part 106*b* of the turn 106. The connection parts THa3 and THa4 are formed so as to be symmetrical with respect to the virtual line L0.

Thus, when the first and second coil parts 100B and 200B are put one over the other through the insulating substrate 11, the inner peripheral end of the conductor part 106*a* of the first coil part 100B and the inner peripheral end of the conductor part 206*b* of the second coil part 200B are connected through the connection part THa3, and the inner peripheral end of the conductor part 106*b* of the first coil part 100B and the inner peripheral end of the conductor part 206*a* of the second coil part 200B are connected through the connection part THa4.

As described above, in the coil component according to the present embodiment, each turn is radially separated by the spiral-shaped slit, so that non-uniformity of current density distribution is reduced as compared to a case where such a slit is not formed. As a result, DC resistance or AC resistance can be reduced. In addition, the conductor parts 101*a* to 106*a* positioned at the outer peripheral side in the first coil part 100B are connected respectively to the conductor parts 201*b* to 206*b* positioned at the inner peripheral side in the second coil part 200B, and the conductor parts 101*b* to 106*b* positioned at the inner peripheral side in the first coil part 100B are connected respectively to the conductor parts 201*a* to 206*a* positioned at the outer peripheral side in the second coil part 200B, thereby canceling the inner/outer peripheral difference. This further uniformizes current density distribution, allowing further reduction in DC resistance or AC resistance.

Further, as compared to the first and second embodiments, the positions of the terminal electrodes E1*a* and E2*b* are interchanged. Thus, in the present invention, the positional relationship between the terminal electrodes E1*a* and E2*b* can arbitrarily be set.

Fourth Embodiment

Figure 8:
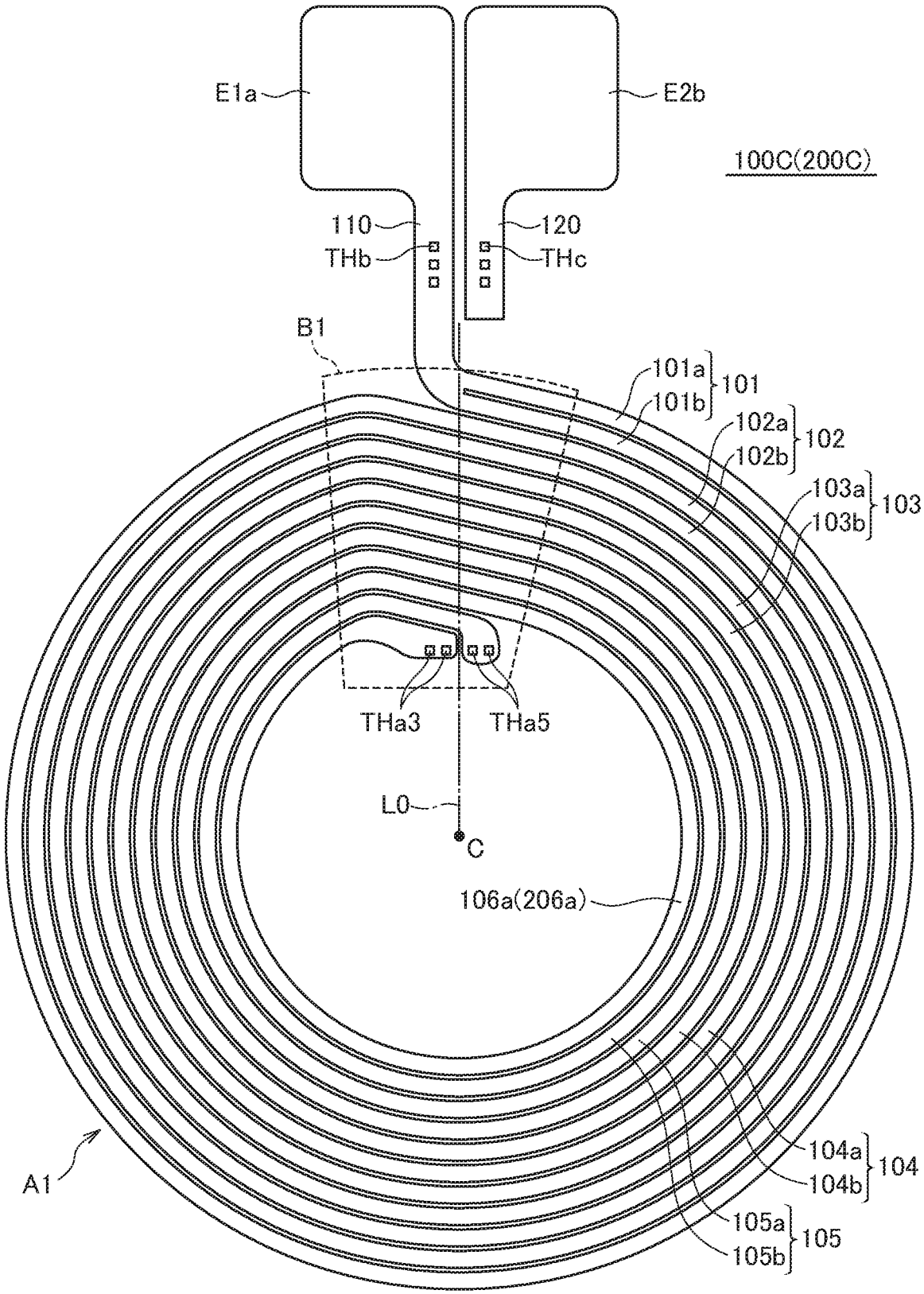
FIG. 8 is a plan view illustrating the pattern shape of a first coil part according to a fourth embodiment of the present invention as viewed from one side of the insulating substrate.

FIG. 8 is a plan view illustrating the pattern shape of a first coil part 100C according to the fourth embodiment as viewed from the surface 11*a* side of the insulating substrate 11.

In the first coil part 100C, the conductor part 106*b* included in the first coil part 100B illustrated in FIG. 7 is removed, and a connection part THa5 is formed at the inner peripheral end of the conductor part 105*b*. Other configurations are the same as those of the coil part 100B illustrated in FIG. 7, so the same reference numerals are given to the same elements, and overlapping description will be omitted. Also in the present embodiment, the first and second coil parts 100C and 200C have the same pattern shape, so reference numerals corresponding to the second coil part 200C are given in parentheses in FIG. 8.

As illustrated in FIG. 8, the connection parts THa3 and THa5 are disposed so as to be symmetrical with respect to the virtual line L0. Thus, when the first and second coil parts 100C and 200C are put one over the other through the insulating substrate 11, the inner peripheral end of the conductor part 106*a* of the first coil part 100C and the inner peripheral end of the conductor part 205*b* of the second coil part 200C are connected through the connection part THa3, and the inner peripheral end of the conductor part 105*b* of the first coil part 100C and the inner peripheral end of the conductor part 206*a* of the second coil part 200C are connected through the connection part THa5.

As a result, a spiral coil of 11 turns in total is constituted, that is, it is possible to realize a spiral coil of an odd number of turns although the coil parts having the same pattern shape are used on the front and back surfaces of the insulating substrate 11.

Fifth Embodiment

Next, a coil component according to the fifth embodiment will be described. The coil component according to the fifth embodiment differs from the coil component according to the first embodiment in that the above-described first and second coil parts 100 and 200 are replaced by first and second coil parts 100D and 200D. Other configurations are the same as those of the coil component according to the first embodiment, so the same reference numerals are given to the same elements, and overlapping description will be omitted.

Figure 9:
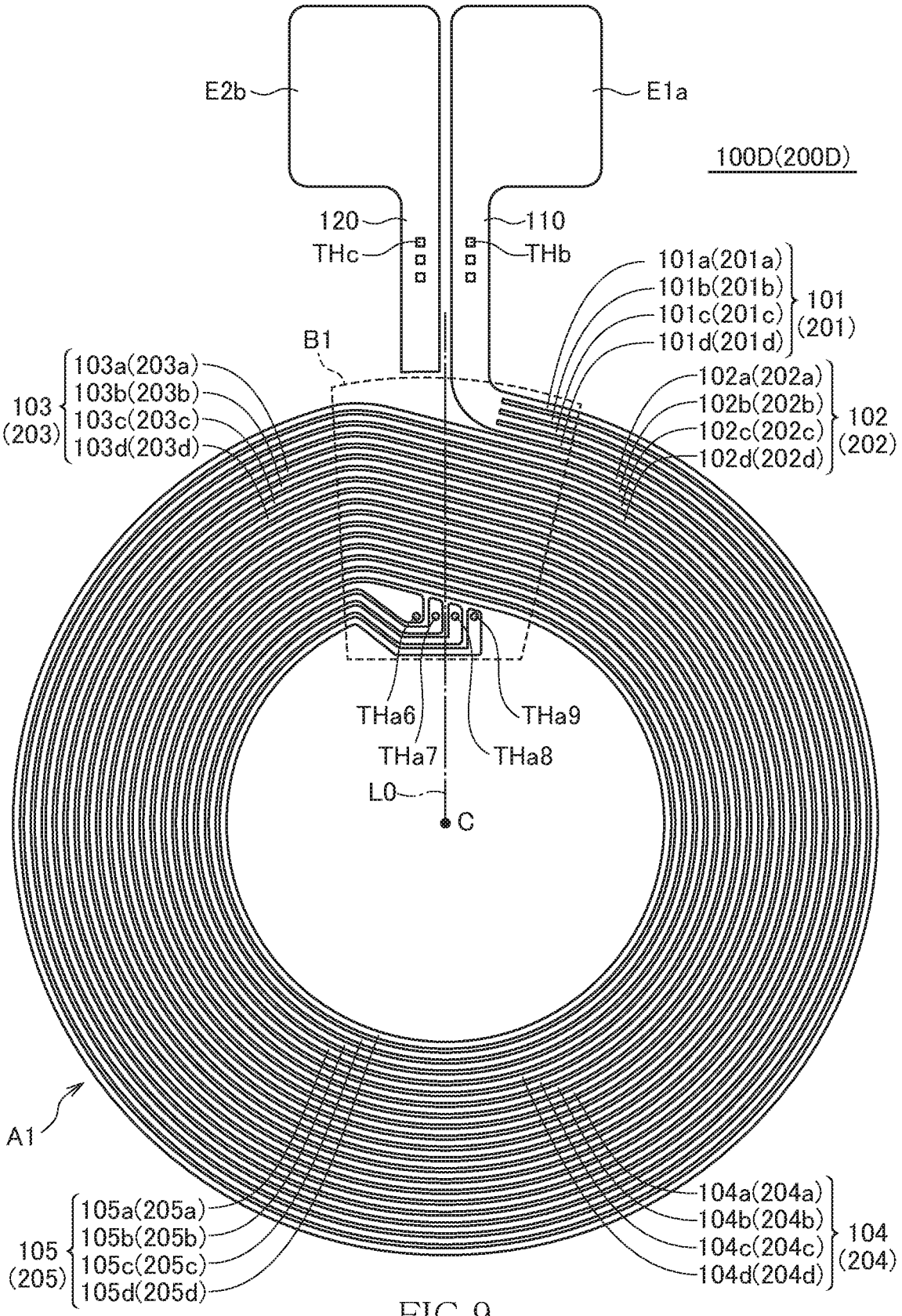
FIG. 9 is a plan view illustrating the pattern shape of a first coil part according to a fifth embodiment of the present invention as viewed from one side of the insulating substrate.

FIG. 9 is a plan view illustrating the pattern shape of the first coil part 100D as viewed from the surface 11*a* side of the insulating substrate 11. Also in the present embodiment, the first and second coil parts 100D and 200D have the same pattern shape, so reference numerals corresponding to the second coil part 200D are given in parentheses in FIG. 9.

As illustrated in FIG. 9, the first coil part 100D has five turns including turns 101 to 105 and, thus, a spiral coil of 10 turns in total is constituted. The turns 101 to 105 are each radially separated into four sections by three spiral-shaped slits. As a result, the turns 101 to 105 are separated, respectively, into conductor parts 101*a* to 105*a* positioned at the outermost peripheral side, conductor parts 101*b* to 105*b* positioned at the second outermost peripheral side, conductor parts 101*c* to 105*c* positioned at the second innermost peripheral side, and conductor parts 101*d* to 105*d* positioned at the innermost peripheral side. Connection parts THa6 to THa9 are formed at the inner peripheral ends of the respective conductor parts 105*a* to 105*d* of the innermost turn 105. The connection parts THa6 and THa9 are disposed so as to be symmetrical with respect to the virtual line L0, and the connection parts THa7 and THa8 are also disposed so as to be symmetrical with respect to the virtual line L0.

Thus, when the first and second coil parts 100D and 200D are put one over the other through the insulating substrate 11, the inner peripheral end of the conductor part 105*a* of the first coil part 100D and the inner peripheral end of the conductor part 205*d* of the second coil part 200D are connected through the connection part THa6, the inner peripheral end of the conductor part 105*b* of the first coil part 100D and the inner peripheral end of the conductor part 205*c* of the second coil part 200D are connected through the connection part THa7, the inner peripheral end of the conductor part 105*c* of the first coil part 100D and the inner peripheral end of the conductor part 205*b* of the second coil part 200D are connected through the connection part THa8, and the inner peripheral end of the conductor part 105*d* of the first coil part 100D and the inner peripheral end of the conductor part 205*a* of the second coil part 200D are connected through the connection part THa9.

As described above, in the coil component according to the present embodiment, each turn is radially separated into four sections by the three spiral-shaped slits, so that non-uniformity of current density distribution is further reduced. As a result, DC resistance or AC resistance can be further reduced. In addition, the conductor parts 101*a* to 105*a* positioned at the outermost peripheral side in the first coil part 100D are connected respectively to the conductor parts 201*d* to 205*d* positioned at the innermost peripheral side in the second coil part 200D, the conductor parts 101*b* to 105*b* positioned at the second outermost peripheral side in the first coil part 100D are connected respectively to the conductor parts 201*c* to 205*c* positioned at the second innermost peripheral side in the second coil part 200D, the conductor parts 101*c* to 105*c* positioned at the second innermost peripheral side in the first coil part 100D are connected respectively to the conductor parts 201*b* to 205*b* positioned at the second outermost peripheral side in the second coil part 200D, and the conductor parts 101*d* to 105*d* positioned at the innermost peripheral side in the first coil part 100D are connected respectively to the conductor parts 201*a* to 205*a* positioned at the outermost peripheral side in the second coil part 200D, thereby canceling the inner/outer peripheral difference. This further uniformizes current density distribution, allowing further reduction in DC resistance or AC resistance.

Sixth Embodiment

Figure 10:
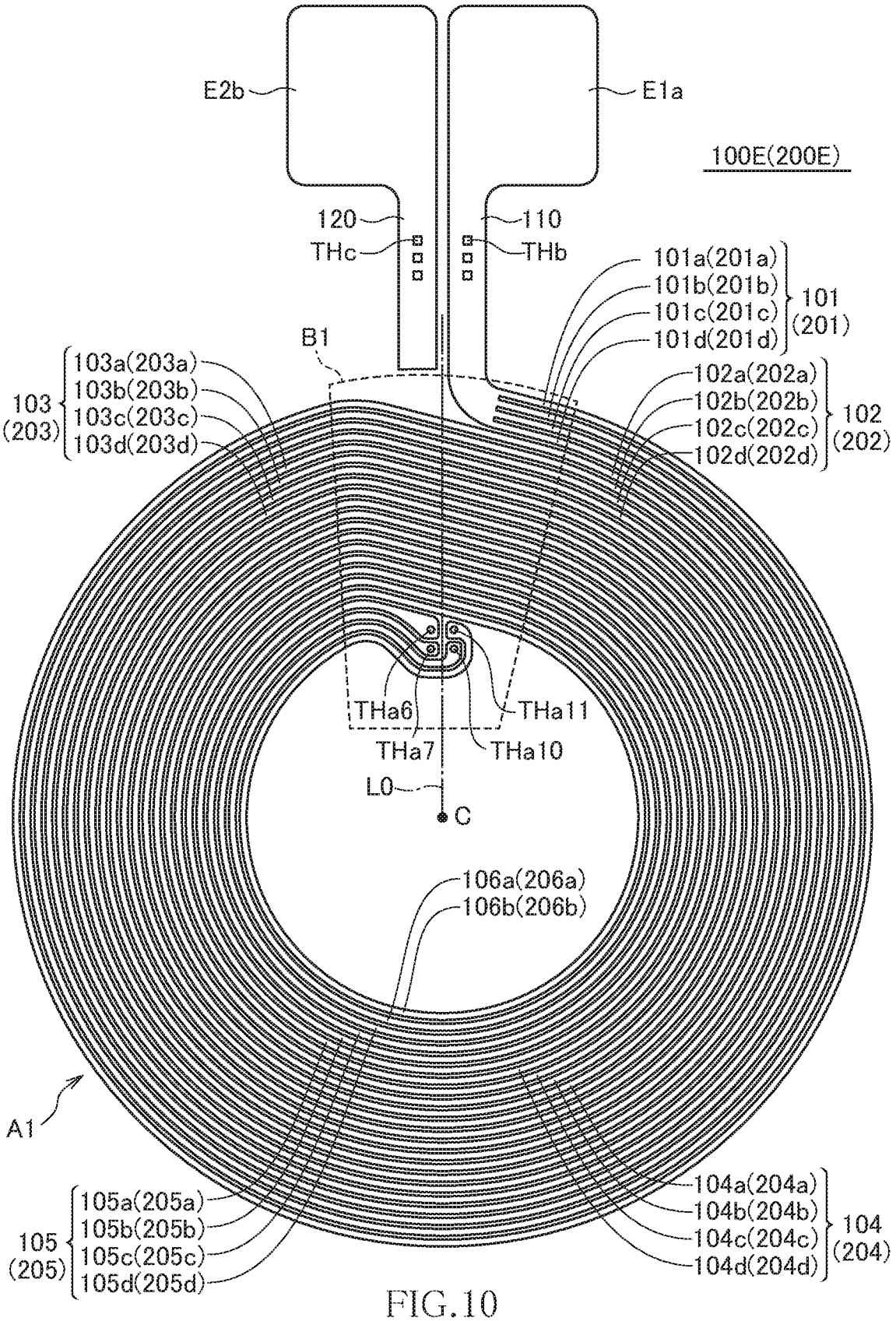
FIG. 10 is a plan view illustrating the pattern shape of a first coil part according to a sixth embodiment of the present invention as viewed from one side of the insulating substrate.
Figure 11:
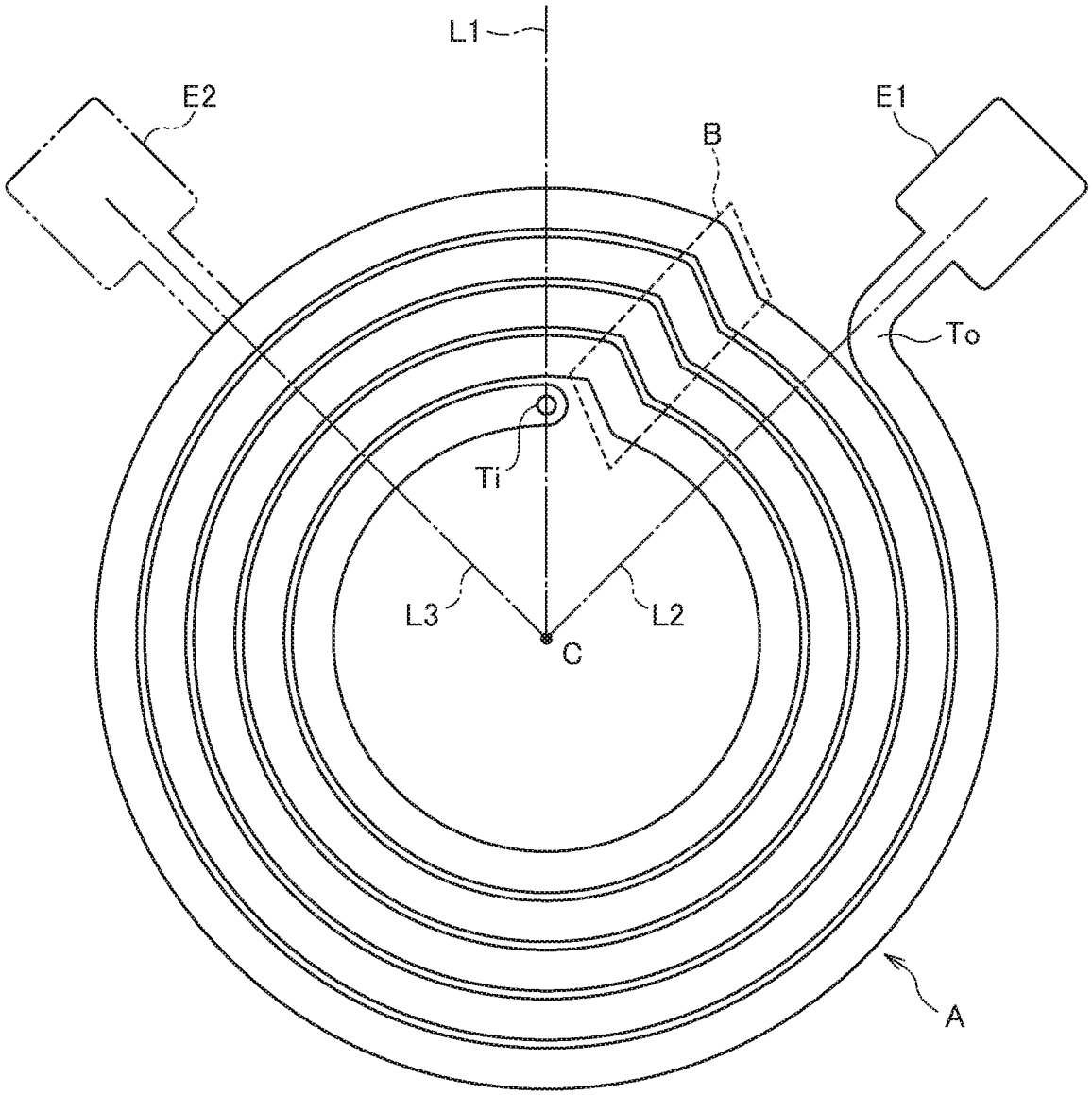
FIG. 11 is a plan view for explaining the pattern shape of a possible coil part.

FIG. 10 is a plan view illustrating the pattern shape of a first coil part 100E according to the sixth embodiment as viewed from the surface 11*a* side of the insulating substrate 11.

In the first coil part 100E, conductor parts 106*a* and 106*b* are added to the first coil part 100D illustrated in FIG. 9, and connection parts THa10 and THa11 are formed at the inner peripheral ends of the conductor parts 106*a* and 106*b*, respectively. Other configurations are the same as those of the first coil part 100D illustrated in FIG. 9, so the same reference numerals are given to the same elements, and overlapping description will be omitted. Also in the present embodiment, the first and second coil parts 100E and 200E have the same pattern shape, so reference numerals corresponding to the second coil part 200E are given in parentheses in FIG. 10.

As illustrated in FIG. 10, the connection parts THa6 and THa11 are disposed so as to be symmetrical with respect to the virtual line L0, and the connection parts THa7 and THa10 are also disposed so as to be symmetrical with respect to the virtual line L0. Thus, when the first and second coil parts 100E and 200E are put one over the other through the insulating substrate 11, the inner peripheral end of the conductor part 105*c* of the first coil part 100E and the inner peripheral end of the conductor part 206*b* of the second coil part 200E are connected through the connection part THa6, the inner peripheral end of the conductor part 105*d* of the first coil part 100E and the inner peripheral end of the conductor part 206*c* of the second coil part 200E are connected through the connection part THa7, the inner peripheral end of the conductor part 106*a* of the first coil part 100E and the inner peripheral end of the conductor part 205*d* of the second coil part 200E are connected through the connection part THa10, and the inner peripheral end of the conductor part 106*b* of the first coil part 100E and the inner peripheral end of the conductor part 205*c* of the second coil part 200E are connected through the connection part THa11.

As a result, a spiral coil of 11 turns in total is constituted, that is, it is possible to realize a spiral coil of an odd number of turns although the coil parts having the same pattern shape are used on the front and back surfaces of the insulating substrate 11.

It is apparent that the present invention is not limited to the above embodiments, but may be modified and changed without departing from the scope and spirit of the invention.

What is claimed is:

1. A coil component comprising:

an insulating substrate having first and second surfaces;

a first coil part formed on the first surface of the insulating substrate, the first coil part being spirally wound in a plurality of turns and radially separated by a spiral-shaped slit into a first conductor part and a second conductor part positioned at an inner peripheral side of the first conductor part;

a second coil part formed on the second surface of the insulating substrate, the second coil part being spirally wound in a plurality of turns and radially separated by a spiral-shaped slit into a third conductor part and a fourth conductor part positioned at an inner peripheral side of the third conductor part;

a first connection part connecting an inner peripheral end of the first conductor part and an inner peripheral end of the fourth conductor part; and a second connection part connecting an inner peripheral end of the second conductor part and an inner peripheral end of the third conductor part, wherein an outer peripheral end of the first coil part and an outer peripheral end of the second coil part are disposed adjacent to each other in a plan view, wherein the plurality of turns constituting the first and second coil parts each have a circumference region in which a radial position is not changed and a shift region in which a radial position is shifted, and wherein the shift region is positioned on a virtual line radially extending from a center point of the first and second coil parts and passing between the outer peripheral end of the first coil part and the outer peripheral end of the second coil part.

2. The coil component as claimed in claim 1, wherein the inner peripheral ends of the first, second, third and fourth conductor parts are positioned within the shift region.

3. The coil component as claimed in claim 1, wherein the first and second coil parts have substantially a same pattern shape as each other.

4. The coil component as claimed in claim 1, wherein the first coil part includes a first turn positioned at an innermost periphery and a second turn positioned at an outer peripheral side of the first turn by one turn, wherein the second coil part includes a third turn positioned at an innermost periphery and a fourth turn positioned at an outer peripheral side of the third turn by one turn, and wherein the connection part has a third connection part connecting the first and fourth turns and a fourth connection part connecting the second and third turns.

5. The coil component as claimed in claim 1, wherein the circumference regions of a plurality of turns constituting the first coil part and the circumference regions of a plurality of turns constituting the second coil part coincide with each other in planar position.

6. The coil component as claimed in claim 5, wherein the insulating substrate is transparent or translucent.

7. A coil component comprising:

a substrate having a first surface and a second surface opposite to the first surface;

a first spiral coil spirally wound in a plurality of turns formed on the first surface of the substrate;

a second spiral coil spirally wound in a plurality of turns formed on the second surface of the substrate; and first and second through conductors penetrating through the substrate, wherein the first spiral coil has an innermost turn including first and second conductive parts separated by a slit, the first and second conductive parts including first and second inner ends, respectively, wherein the second spiral coil has an innermost turn including third and fourth conductive parts separated by a slit, the third and fourth conductive parts including third and fourth inner ends, respectively, wherein the first conductive part is positioned at an outer peripheral side of the second conductive part, wherein the third conductive part is positioned at an outer peripheral side of the fourth conductive part, wherein the first and fourth inner ends are electrically connected to each other by the first through conductor, and wherein the second and third inner ends are electrically connected to each other by the second through conductor.

8. The coil component as claimed in claim 7, wherein each of the turns of the first coil has a first circumference region in which a radial position is substantially fixed and a first shift region in which a radial position is shifted, wherein each of the turns of the second coil has a second circumference region in which a radial position is substantially fixed and a second shift region in which a radial position is shifted, wherein the first and second inner ends are positioned at the first shift region, and wherein the third and fourth inner ends are positioned at the second shift region.

9. The coil component as claimed in claim 7, wherein the first and second through conductors are arranged in a circumferential direction.

10. The coil component as claimed in claim 7, wherein the first, second, third, and fourth conductive parts including first, second, third, and fourth outer ends, respectively, wherein the first and second outer ends are short-circuited on the first surface of the substrate, and wherein the third and fourth outer ends are short-circuited on the second surface of the substrate.

11. The coil component as claimed in claim 7, wherein the first inner end is positioned at an innermost turn of the first coil, wherein the second inner end is positioned at a predetermined turn of the first coil different from the innermost turn of the first coil, wherein the third inner end is positioned at an innermost turn of the second coil, and wherein the fourth inner end is positioned at a predetermined turn of the second coil different from the innermost turn of the second coil.

12. The coil component as claimed in claim 11, wherein the innermost turn of the first coil is narrower than the predetermined turn of the first coil in width, and wherein the innermost turn of the second coil is narrower than the predetermined turn of the second coil in width.

13. A coil component comprising:

a substrate having a first surface and a second surface opposite to the first surface;

a first spiral coil wound in a plurality of turns formed on the first surface of the substrate;

a second spiral coil wound in a plurality of turns formed on the second surface of the substrate; and first and second through conductors penetrating through the substrate, wherein the first and second through conductors are arranged in a circumferential direction, wherein the first spiral coil has an innermost turn including first and second conductive parts separated by a slit, the first and second conductive parts including first and second inner ends, respectively, wherein the second spiral coil has an innermost turn including third and fourth conductive parts separated by a slit, the third and fourth conductive parts including third and fourth inner ends, respectively, wherein the first conductive part is positioned at an outer peripheral side of the second conductive part, wherein the third conductive part is positioned at an outer peripheral side of the fourth conductive part, wherein the first and fourth inner ends are electrically connected to each other by the first through conductor, and wherein the second and third inner ends are electrically connected to each other by the second through conductor.

14. The coil component as claimed in claim 13, wherein the first, second, third, and fourth conductive parts including first, second, third, and fourth outer ends, respectively, wherein the first and second outer ends are short-circuited on the first surface of the substrate, and wherein the third and fourth outer ends are short-circuited on the second surface of the substrate.

* * * * *